United States Patent [19]

Vöhringer

[11] 4,361,419

[45] Nov. 30, 1982

[54] GEROTOR LIQUID PUMP MOUNTED ON A SUPPORT BUSHING

[75] Inventor: Karl Vöhringer, Kuppenheim, Fed. Rep. of Germany

[73] Assignee: Volksbank-Raiffeisenbank Buhl e.G., Buhl, Fed. Rep. of Germany

[21] Appl. No.: 64,696

[22] Filed: Aug. 8, 1979

[30] Foreign Application Priority Data

Aug. 8, 1978 [DE] Fed. Rep. of Germany ..... 2834735

[51] Int. Cl.[3] ..... F04C 2/10; F04C 13/00; F04C 15/00

[52] U.S. Cl. ..... 418/73; 418/171; 418/182

[58] Field of Search ..... 418/71, 73, 166, 171, 418/182

[56] References Cited

U.S. PATENT DOCUMENTS

| | | | |
|---|---|---|---|
| 2,124,140 | 7/1938 | Foster et al. | 418/72 |
| 2,386,896 | 10/1945 | Hill et al. | 418/73 |
| 2,634,582 | 4/1953 | Klatte et al. | 418/171 |
| 2,721,541 | 10/1955 | Nubling | 418/171 |
| 2,993,450 | 7/1961 | Weigert | 418/71 |
| 3,015,282 | 1/1961 | Camarata | 418/72 |
| 3,133,694 | 5/1964 | Luck | 418/171 |
| 3,619,093 | 11/1971 | Harle et al. | 418/73 |
| 3,887,310 | 6/1975 | Gerber | 418/73 |

FOREIGN PATENT DOCUMENTS

| | | | |
|---|---|---|---|
| 1553032 | 9/1969 | Fed. Rep. of Germany | 418/171 |

*Primary Examiner*—John J. Vrablik

*Attorney, Agent, or Firm*—Allison C. Collard; Thomas M. Galgano

[57] ABSTRACT

A liquid pump, in particular for liquids having a low viscosity, for example, water, alcohols or other chemical liquids is provided of the type which includes a gear unit or a gerotor mounted in a housing which has an inner gear driven by a shaft. The inner gear of the gear unit is mounted on a bushing, the width of which is determined by the required hydrostatic support forces in such a manner that the support faces lie directly in the plane of the hydraulic radial forces.

6 Claims, 4 Drawing Figures

GEROTOR LIQUID PUMP MOUNTED ON A SUPPORT BUSHING

The present invention relates to liquid pumps. More particularly, it relates to pumps for liquids having a low viscosity; for example, water, alcohols or other chemical liquids.

Such types of liquid pumps are known which are suitable for a certain pressure range and which consist of a gear unit or a gerotor which is mounted in a housing. The gear unit or the gerotor has an inner gear which is driven by a shaft which is coupled with a drive element.

However, hitherto known liquid pumps of the above-mentioned type have a crucial disadvantage in that they could not be used in particular with liquids having a low viscosity, especially at pressures in a pressure range of >25 b. This was because the forces exerted onto the drive shaft were so great that the danger of deformation of the drive shaft existed. Furthermore, the bearings of the shaft were exceedingly stressed, so that they wore out prematurely, or did not permit operation under high pressures.

It is therefore an object of the present invention to provide a liquid pump of the aforementioned type which can be used for pumping of liquids having a low viscosity, for example, water, alcohols or other chemical liquids, and which can be used in a pressure range of 0 to 50 b, without causing inner deformations or a premature wear and tear of the pump.

This object of the invention is obtained by providing a liquid pump, especially intended for liquids having a low viscosity, such as, water, alcohols or other chemical liquids, which basically consists of a gear unit or a gerotor mounted in a housing, and having an inner gear which is driven by a shaft. The pump is characterized in that the inner gear of the gear unit is mounted on a bushing, the width of which is determined by the required hydrostatic support forces in such a manner that the support forces are immediately present or lie directly in the plane of the hydraulic radial forces.

In accordance with the specific embodiment of the invention, the bushing is mounted on a central support bolt which is provided with hydrostatic support pockets which are coupled by means of conduits for the pressure and suction side with pump coupling chambers or relief pockets for the purpose of the support effect. The leakage discharge is carried out by means of a central bore in the support bolt, and an oil exchange takes place between the bushing sides through bores in this bushing.

Due to the measures taken in the subject invention and, in particular, due to the arrangement of the inner gear on the bushing and the mounting of this bushing on a central mounting bolt with the hydrostatic support pockets, the functioning or operation of the pump is assured at higher pressures at a pressure range of >40 b, a significant advantage. Furthermore, in accordance with the inventive pump, an oil exchange takes place between the bushing sides through bores, which is of a particular advantage, in view of the mode of operation of the pump.

Furthermore, the bushing may be provided with two cams, for example, two teeth which engage coupling elements of the drive shaft, whereby any center offset and alignment deviation of the teeth are compensated with the coupling.

Finally, one support unit consists of a plurality of individual pockets on the support bolt. The pockets end in a flat, acute angle and the support unit also has grooves, which define two sealing ribs which extend to a second support face. The inner gear of the gear unit may transmit a torque by means of one or a plurality of radial cam pins having a round cross section. These cam pins are mounted in bores of the bushing and engage grooves which are provided on the inner gear.

The preferred embodiment of the invention is now explained in more detail in conjunction with the appended drawings.

Figure 3:
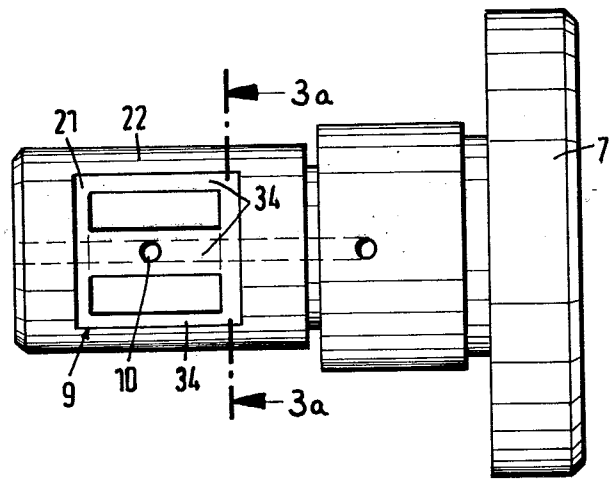
FIG. 3 is a plan view of the central support bolt for the bushing.
Figure 3A:
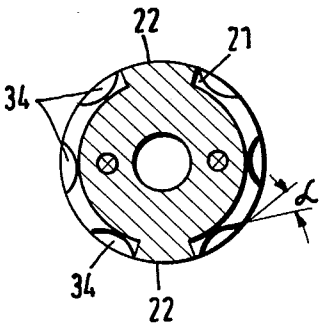

FIG. 3*a* is a sectional view taken along line 3*a*—3*a* of FIG. 3.

As can be seen from the drawings, the liquid pump in accordance with the present invention consists of two housing parts 1 and 2, which encompass a housing ring 3 disposed therebetween and which are screwed together. A gear unit is mounted within ring 3 which consists of an inner gear 4 and an outer gear 5. In accordance with the invention, inner gear 4 is mounted on a bushing 6, which, in turn, is mounted on a central support bolt 7.

Figure 1:
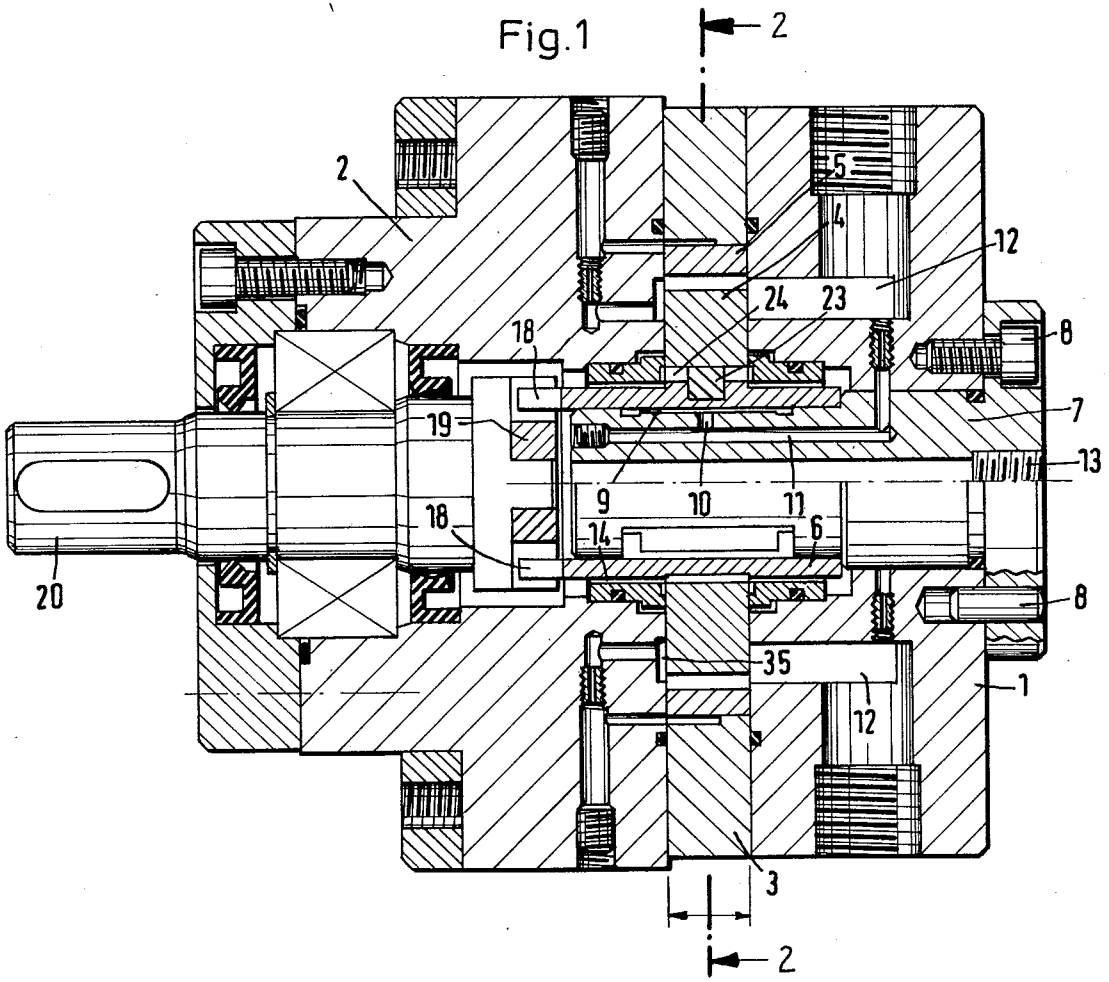
FIG. 1 is a longitudinal sectional view, in part elevation, through the liquid pump, in accordance with the invention.
Figure 2:
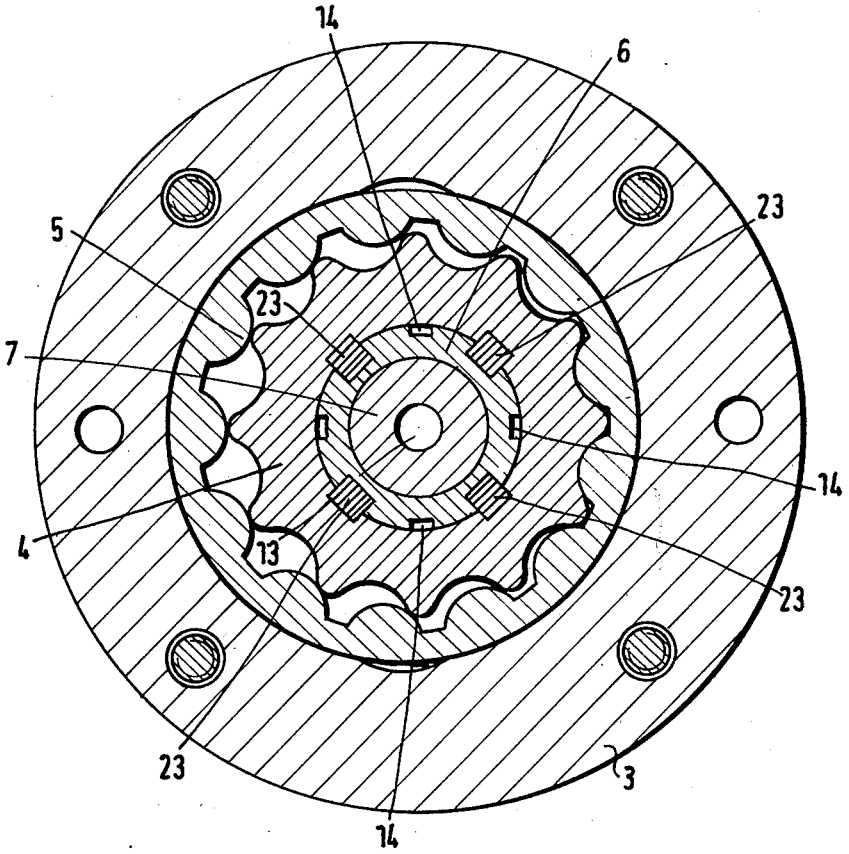
FIG. 2 is a sectional view taken along line 2—2 of FIG. 1.

Central support bolt 7 is screwed into housing part 1 by means of screws 8. In the range of bushing 6, support bolt 7 is provided with a hydrostatic support pocket 9, (see FIG. 3) containing a plurality of individual pockets 34 (see FIG. 3*a*). These pockets 34 communicate with the pump coupling chambers 12 and relief pockets 35 via conduits 10 and 11 for the pressure and suction side of the pump relief pockets 35 communicating with chambers 12 via the opening between the teeth of gears 4 and 5 (see FIG. 1). This arrangement provides a supporting effect on the bushing. The leak discharge is carried out by means of a central bore 13 in support bolt 7 (see FIG. 1). Furthermore, an oil exchange can take place between the bushing sides by means of bores 14 which extend therebetween as seen best in FIG. 1, thereby balancing the pressure on the two gear plane faces.

Bushing 6 may be provided with cams, for example, two teeth 18 which engage in coupling elements 19 of drive shaft 20. Thereby, any center offset of the drive shaft and alignment deviation will be compensated for with this coupling, and the drive shaft is free from hydraulic return effects, so that it is available for the sole reception of the drive forces and does not make any requirements on the drive means, which is a particular advantage. The support face unit or pocket 9 on support bolt 7 may consist of a plurality of individual pockets 34 which together with circumferential face 22 define a generally flat or acute angle $\alpha$, which produces a so-called oil wedge formation during rotation of bushing 6. Support face unit 9 has circumferential grooves 21 (FIG. 3), which define two sealing ribs 22 which lead into a second support face unit or pocket.

Inner gear 4 of the gear unit may have one or a plurality of radial cam pins 23 with a round cross section, which are mounted in grooves 24 within bushing 6. Thereby, the torque can be transmitted to inner gear 4, while the gear still retains enough freedom for adjusting to the cam faces of the housing parts and its gear, which is important, in particular, when higher pressures are present.

In operation, a pressure differential is established as a result of which one chamber 12 is under a higher pressure and the other chamber 12 is under a lower pressure. Inasmuch as each of the relief or balancing pockets 35 communicate via the spaces between the gear teeth with the corresponding pumper chamber 12 and due to the fact that they have the same cross-section dimensions or shape, they cooperate therewith to establish a power balance in an axial direction on both sides of the gears.

During operation, the hydrostatic support pockets 9 provided on support bolt 7 are admitted with hydraulic pressure via the corresponding conduits 10 and 11 to the corresponding pump chambers 12, (i.e., one pocket 9 being connected to the higher pressure chamber 12 and the other pocket 9 to the lower pressure chamber 12), so as to counterbalance the higher and lower pressure forces formed between the teeth of the gerotor gears 4, 5. A support power distribution curve is generated with the support forces being effective radially outwardly and which are largest below the center of the gear and are zero at the ends of bushing 6. Thereby, the desired pressure field of the support power distribution is below gear 4 with the support forces lying directly in the effective plane of the hydraulic radial forces, i.e., the radially inwardly directed forces acting on gear 4 along its axial width.

While only a single embodiment of the present invention has been shown and described, it will be obvious to those persons of ordinary skill in the art, that many changes and modifications may be made thereunto, without departing from the spirit and scope of the invention.

What is claimed is:

1. A liquid pump for liquids having a low viscosity, including water, alcohols or other chemicals of the type which includes a gear unit mounted in a housing which has an outer gear and an inner gear eccentrically mounted with respect to said outer gear forming variable spaces between the gear teeth, said inner gear being driven by a shaft, the improvement comprising:

(a) a bushing on which said inner gear of said gear unit is mounted, the length of said bushing in the axial direction being longer than the width of said inner gear, said bushing also having axially extending bores therethrough so that an oil exchange takes place between the bushing sides through said bores, (b) pump coupling chambers in said housing for the pressure and suction sides of the pump disposed on one axial side of said gears, (c) relief pockets formed in said housing on the other axial side of said gears, which communicate with said pump coupling chambers via said spaces between said teeth of said outer and inner gears, (d) a central support bolt on which said bushing is mounted having hydrostatic support pockets formed in the peripheral surface thereof beneath said bushing and conduit means for connecting said support pockets to the pump coupling chambers, the length of said support pockets in the axial direction being longer than the axial width of said inner gear, the lengths of said bushing and support pockets being determined by the required hydrostatic support forces in such a manner that the support forces lie directly in the effective plane of the hydraulic radial forces, said support bolt also having a central bore for carrying out any leakage discharge.

2. The liquid pump in accordance with claim 1, wherein one support pocket consists of a plurality of individual pockets on said support bolt, said pockets ending in a relatively flat acute angle and being encompassed by grooves, so as to define two support units separated by two sealing ribs.

3. The liquid pump according to claim 1, wherein said inner gear has a width which is appreciably less than the length of said bushing.

4. The liquid pump in accordance with claim 1 wherein said inner gear is centrally disposed on said bushing.

5. The liquid pump in accordance with claim 1, wherein said bushing is provided with cams, which engage coupling elements of said shaft, so that the center offset and the alignment deviation of said teeth may be compensated with said coupling.

6. The liquid pump in accordance with claim 5, wherein said cams comprise two teeth.

* * * * *